US006050644A

United States Patent [19]

Neal

[11] Patent Number: 6,050,644

[45] Date of Patent: Apr. 18, 2000

[54] PORTABLE ARMREST

[76] Inventor: Robert Neal, 408 E. Route 66, Flagstaff, Ariz. 86001

[21] Appl. No.: 09/211,988

[22] Filed: Dec. 14, 1998

[51] Int. Cl.[7] ..... A47C 7/54

[52] U.S. Cl. ..... 297/411.24; 297/DIG. 10

[58] Field of Search ..... 297/411.1, 411.2, 297/411.23, 411.24, DIG. 10

[56] References Cited

U.S. PATENT DOCUMENTS

| | | | |
|---|---|---|---|
| D. 393,292 | 4/1998 | Oren et al. . | |
| 1,378,704 | 5/1921 | McPartland . | |
| 4,728,119 | 3/1988 | Sigafoo . | |
| 4,854,638 | 8/1989 | Marcus et al. . | |
| 5,149,033 | 9/1992 | Burzler . | |
| 5,868,463 | 2/1999 | McKenzie et al. | 297/228.12 |

FOREIGN PATENT DOCUMENTS

| | | |
|---|---|---|
| 203258 | 10/1908 | Germany . |

*Primary Examiner*—Anthony D. Barfield
*Attorney, Agent, or Firm*—Brown, Martin, Haller & McClain, LLP

[57] ABSTRACT

A portable armrest (100) provides assistance in rising from or descending into a armless sitting device (10) such as a chair, sofa, couch, bench or vehicle seat. Two handles (110, 112) are connected to a base having a shape that allows the user to sit directly on the seating surface (20) of the armless sitting device (10).

15 Claims, 3 Drawing Sheets

PORTABLE ARMREST

BACKGROUND OF THE INVENTION

1. Field of the Invention

The present invention relates in general to furniture and more specifically to a portable armrest.

2. Description of the Related Art

Armrests that are part of chairs or other furniture are typically used for more than support for the user's hands or arms when seated in the chair. These armrests are often used for support when rising from a seated position to a standing position or when sitting down in the chair. The armrests allow users to gradually move their center of gravity to a position over their feet by supporting themselves with their arms on the arms rests as they rise from the seated position. Similarly, users can gradually move their center of gravity from over their feet to over the chair as they become seated in the chair.

Many articles of furniture used for sitting, however, do not have armrests or any other structure which can be used for assistance in changing from a sitting to a standing position. The absence of armrests on these articles (armless sitting devices) can be more than troublesome to many injured, elderly and physically challenged persons. For example, people with hip, leg, knee or back injuries often cannot rise from a seated position in an armless sitting device without supporting themselves with their arms. Often these people are placed in the embarrassing situation of requiring assistance from others in rising from an armless chair. Further, these people may be placed in dangerous situations when forced to use the edge of a table (or other unstable article) for support as they rise from or descend into the armless sitting device. The table may move due to the added force of the persons weight and result in injury.

Often, physically challenged persons are deterred from engaging in certain activities because of the embarrassing or possible dangerous consequences in sitting in public or private places that do not provide sitting devices with armrests. For example, most restaurants provide only armless chairs for seating.

Therefore, there exists a need for a portable armrest for providing a support structure to assist users in rising from and descending into armless sitting devices.

SUMMARY OF THE INVENTION

In an embodiment of the invention, a portable armrest provides a support structure for an armless sitting device such as an armless chair, bench, couch, sofa, or vehicle seat by providing two handles mounted to a base that interfaces to the seating surface of the armless sitting device. The base has a shape providing an opening that allows the user to sit directly on the seating surface of the armless sitting device. The base is secured to the seating surface with a safety strap connected to the base across the opening. A base strap connected across the opening allows the apparatus to be used with armless sitting devices with seating surfaces having a width less than the size of the opening within the base.

In an alternate embodiment, the handles are attached to the base with hinges allowing the portable armrest to be more conveniently transported. The handles can be folded down towards the base when the portable armrest is not in use resulting in a more compact and portable assembly.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figure 1:
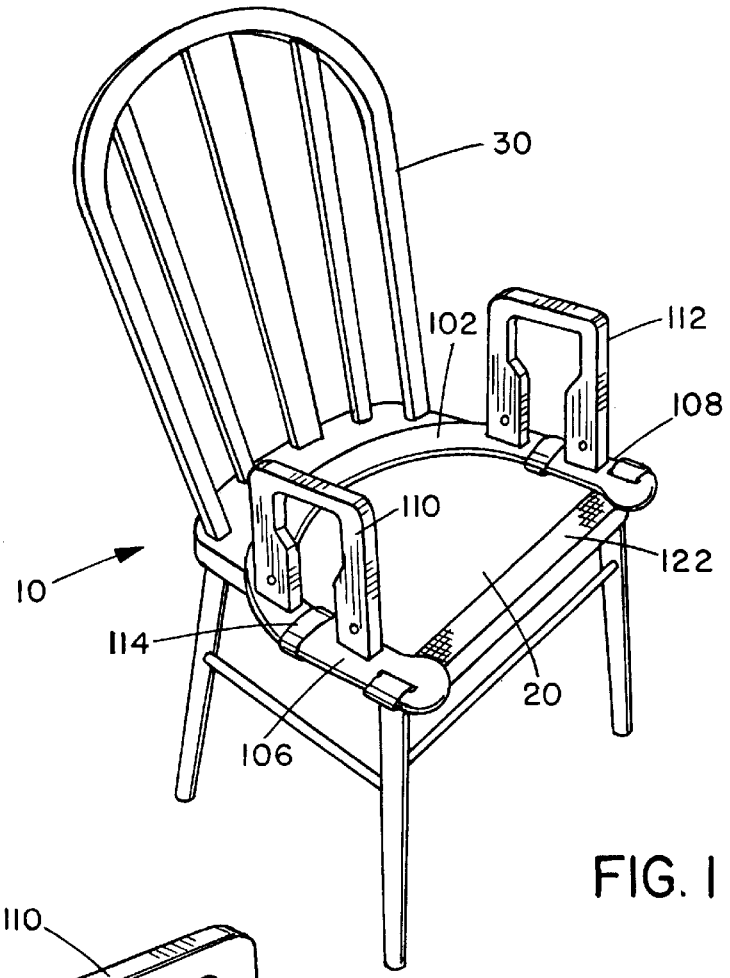
FIG. 1 is a drawing of a perspective view of a portable armrest (apparatus) 100 to an armless sitting device 10 in accordance with a prefered embodiment of the present invention.

FIG. 1 is a drawing of a perspective view of a portable armrest (apparatus) 100 to an armless sitting device 10 in accordance with a preferred embodiment of the present invention. Although the armless sitting device 10 in FIG. 1 is a chair (10), the portable armrest 100 can be used with various other types of armless sitting devices 10 such as sofas, couches, benches, or vehicle seats. Further, the portable armrest 100 can be used in other situations such as when the user sits on the ground or on steps. In the preferred embodiment, the portable armrest 100 is placed on a seating surface 20 of an armless sitting device 10 and secured using a safety strap 114. A buckle 120 allows the safety strap to be adjusted to accommodate different sizes of armless sitting devices 10. The safety strap 114 is positioned below the seating surface 20 and tightened to firmly secure a base 102 of the portable armrest 100 over the seating surface 20. Two handles 110, 112 connected to the base 102 provide the user with a support structure to assist in changing from a seated position to a standing position and vice versa. The base 102 is shaped to allow the user to sit directly on the seating surface 20. Depending on the type of sitting device 20, it may be impractical to use the safety strap 114. For example, if the apparatus is used on a sofa or a wide bench (not shown), it may be difficult to secure the safety strap 114 under the seating surface 20 and the portable armrest 100 is placed on the seating surface 20 without using the safety strap 114. Also, in the preferred embodiment, the base 102 does not interfere with the user's use of the back rest 30 of the armless sitting device 10.

Figure 2:
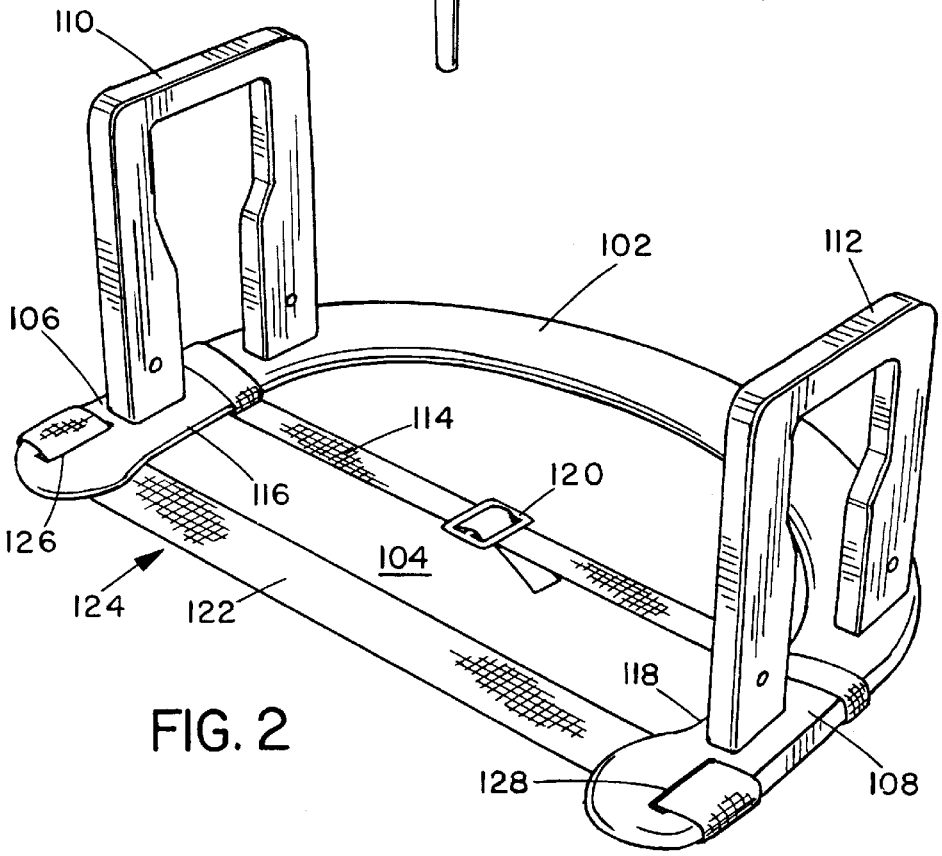
FIG. 2 is a perspective view of the portable armrest 100 for providing a support structure in accordance with the preferred embodiment of the present invention.

FIG. 2 is a drawing of a perspective view of the portable armrest 100 for providing a support structure in accordance with the preferred embodiment of the present invention. In the preferred embodiment, a first handle 110 and a second handle 112 are connected to a base 102. As discussed above, the base 102 is adapted to interface to a seating surface of an armless sitting device 10 such as the seat of a chair, couch, sofa, bench, vehicle seat. Preferably, the base 102 has a horseshoe shape (U-shape) that forms an opening 104 between a first portion 106 and a second portion 108 of the base. The opening 104 has a size that allows a user of the portable armrest 100 to sit directly on the seating surface 20 of the sitting device 10 between a first inner face 116 of the first portion 106 and a second inner face 118 of the second portion 108. Although in the preferred embodiment the base has a U-shape, the base 102 may have any one of various shapes that result in an opening 104 that exposes the seating surface 20 and allows the user to sit on the seating surface. For example, the base 102 may have a rectangular shape with one of the sides of the rectangle removed.

The safety strap 114, preferably made of nylon, secures the portable armrest 100 to the sitting device 10. The safety strap 114 is connected to the base across the opening between the first portion 106 and the second portion. As discussed above, a buckle 120 is used to adjust the length of the safety strap 114 enabling the portable armrest 100 to be used with sitting devices 10 having different sizes.

A base strap 122 is connected across the opening between the first portion 106 and the second portion 108 at the open end 124 of the base 102. The base strap 122 is preferably a nylon strap secured to the base 102 by threading the base strap 122 through base strap slots 126, 128 in the base 102. Preferably, the two ends of the base strap 122 are secured to the body of the base strap 122 using hook-and-loop fasteners such as Velcro® brand fasteners. Other fasteners known in the art, however, may be used. The base strap 122 provides support to the base 102 when the apparatus 100 is used with a seating surface having a width less than the size of the opening 104. In this situation, the base strap 122 keeps the base 102 level with the seating surface by resting on the seating surface. The base strap 122 also reduces flexing of the base 102 by minimizing the movement between the first portion 106 and the second portion 108.

Preferably, the base 102 and the two handles 110, 112 are made from wood such as Baltic birch plywood. As will be apparent to those skilled in the art, other materials may be used without deviating from the intended scope of the invention. For example, the base 102 and the handles 110, 112 may be molded from a single piece of plastic. Various other material having sufficient weight and strength characteristics may also be used such as steel, aluminum, fiberglass, and various plastics.

Figure 3:
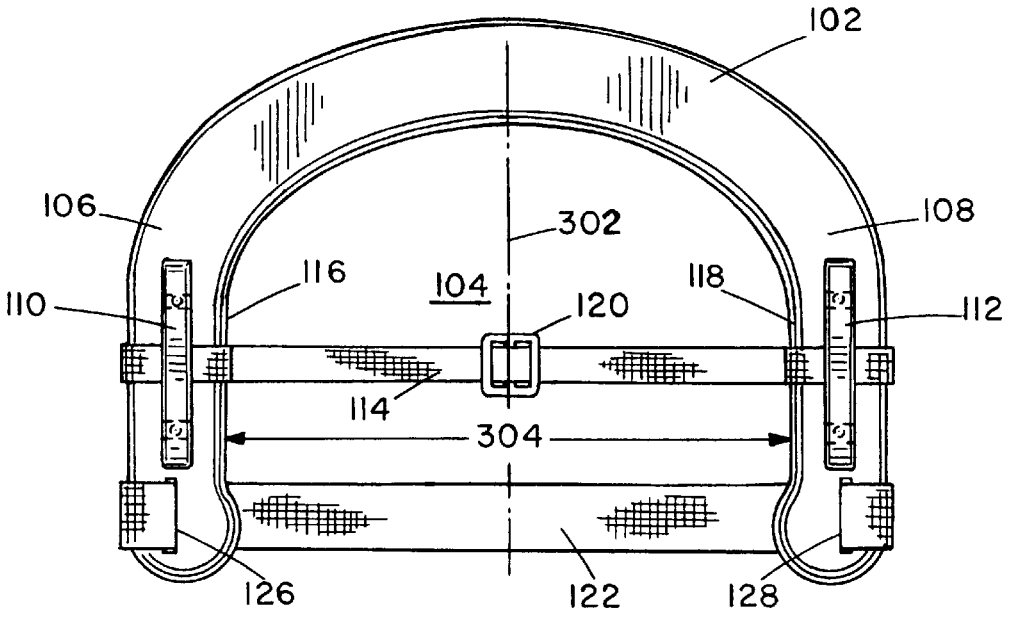
FIG. 3 is drawing of a top view of the portable armrest 100 in accordance with the preferred embodiment of the invention.

FIG. 3 is drawing of a top view of the portable armrest 100 in accordance with the preferred embodiment of the invention. In the preferred embodiment, the first portion 106 of the base 102 and the second portion are separated by a center axis 302 (illustrated by a dashed line in FIG. 3). As shown in FIG. 3, the first portion 106 is a mirror image of the second portion 108. Each of the two handles 110, 112 is, preferably, shaped to be a mirror image of the other and is connected to the base in a location symmetric about the center axis 302 from the other.

In the preferred embodiment, the opening 104 between the first inner face 116 and the second inner face 118, has a width 304 approximately equal to fifteen inches. However, the portable armrest 102 may be manufactured to accommodate different size persons or armless sitting devices 30 by modifying the width 304 of the opening 104. For example, a width 304 of twelve inches may be more appropriate for a small child using the portable armrest 102. Also, a portable armrest 102 with an opening having a width 304 of twenty inches can be used with persons with a larger than average build.

Figure 4:
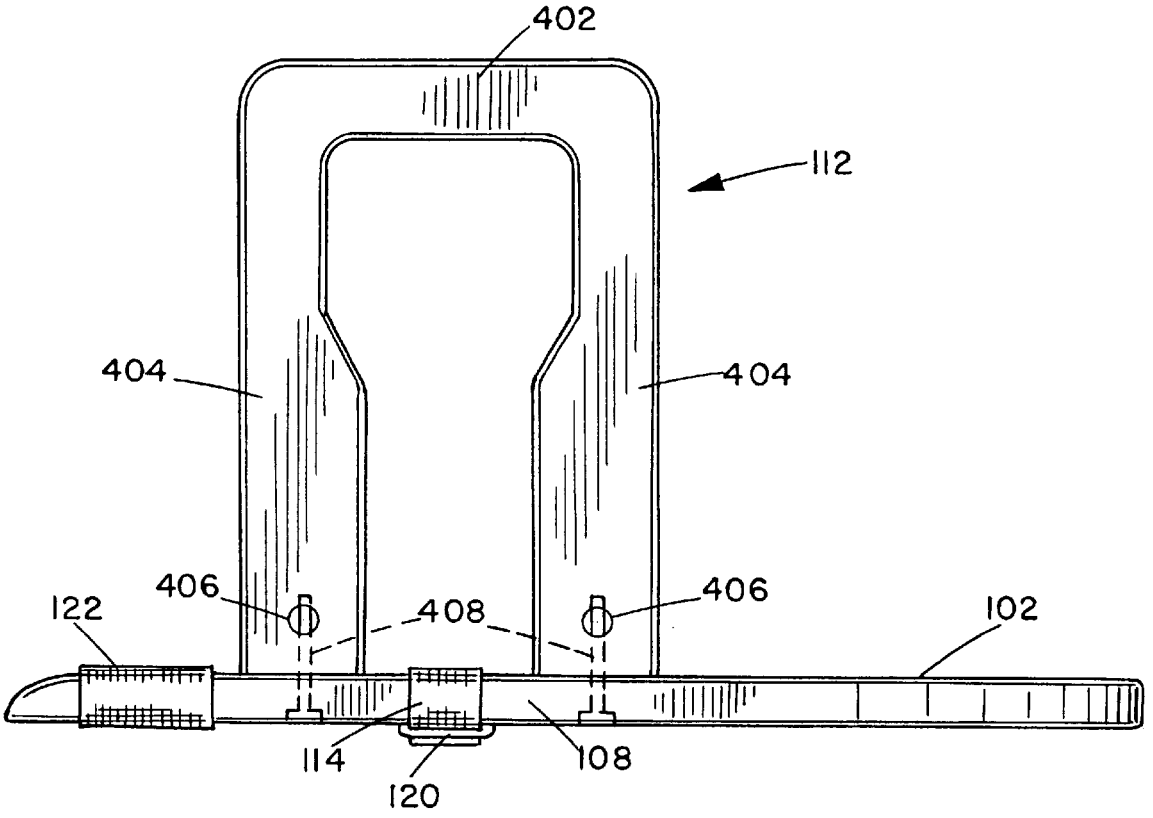
FIG. 4 is drawing of the side view of the portable armrest 100 in accordance with the preferred embodiment of the invention.

FIG. 4 is drawing of the side view of the portable armrest 100 in accordance with the preferred embodiment of the invention. Each of the handles 110, 112 preferably includes a handle grip 402 and two handle supports 404. Each of the handles 110, 112 is connected to the corresponding portion 106, 108 of the base 102 using cross dowels 406 and bolts 408. The two handle supports 404 of each handle 110, 112 have a hole for receiving the cross dowel 406 and a hole for the bolt 408. In other embodiments, the handles 110, 112 may have any one of various shapes and may be attached to the base using any one of various techniques. For example, each of the handles may have a handle grip 402 connected to a single support (404).

In the preferred embodiment, the distance 410 from the top of the handle grip 402 to the base 102 is approximately eight and a half to nine inches which is chosen based on the most common designs of furniture having armrests. The distance 410, however, may be modified to accommodate different size persons of the preferences of users. For example, the distance 410 for a portable armrest 100 to be used by a child may be slightly less than the eight and half inch standard.

Therefore, the portable armrest 100 provides a support structure to assist the user in rising from and descending onto an armless sitting device 30. The shape of the base 102 allows the user to sit directly on the seating surface 20 of the armless sitting device 30. The portable armrest 100 can conveniently be transported to various locations providing the user with the freedom of sitting in many private and public places without the embarrassment or danger of not having armrests to assist the user in using an armless sitting device 30.

Figure 5:
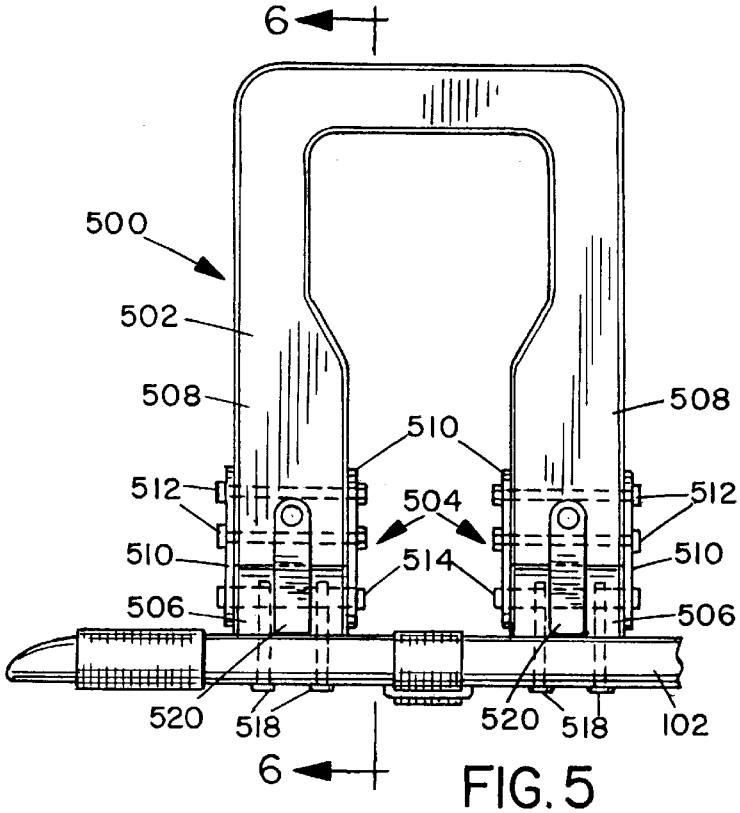
FIG. 5 is a drawing of a side view of an inside face of a portable armrest 500 in accordance with a first alternate embodiment of the invention.

FIG. 5 is a drawing of a side view an inside face of the portable armrest 500 in accordance with a first alternate embodiment of the invention. The portable armrest 500 in the alternate embodiment is constructed as described above in reference to the preferred embodiment except that the first handle 502 and the second handle (not shown) are connected to the base through a first hinge 504 and a second hinge (not shown) respectively. As in the preferred embodiment, the portable armrest 500 is symmetric about the center axis 302 and first handle 502 and the first hinge 504 are mirror images of the second handle and the second hinge. Therefore, in the interest of brevity, only the first handle 502 and the first hinge 504 will be described in detail.

In the first alternate embodiment, the handle 503 is connected to the base 102 through two hinge blocks 506. The hinge 504 formed between the top portion and the two hinge blocks 506 allow the handle 502 to fold toward the opening 104 of the base 102. Therefore, in the first alternate embodiment, both the first hinge 502 and the second hinge include two separate hinge subassemblies. In a second alternate embodiment described below, the hinge is a single hinge and does not include two separate hinge assemblies.

Each handle support 508 is connected to the hinge blocks 506 with two metal plates 510. The metal plates are connected to the supports using two bolts 512 where each of the bolts 512 passes through a hole in each handle support 508. Therefore, each handle support 508 is clamped between the two metal plates 510 using the bolts 512. The metal plates 510 are, preferably, aluminum. Any material, however, having suitable strength and weight characteristics can be used. Further, other fasteners such as screws can be used to mount the metal. plates 510 to the handle supports 508.

The hinge blocks 506 are attached to the base using a cross dowel 514 and two bolts 518. The cross dowel 514, in addition to providing a threaded hole for each of the bolts 518 to thread into, provides a pivot for the hinge 504. The metal plates 510 have holes which are slightly larger than the cross dowels 514 allowing the plates to freely move around the cross dowel 514. Therefore, the handle 502 can be folded down toward the opening 104 by pivoting the handle 502 at the pivot point created at the center of the cross dowels 514.

A lock 520 secures the handle 502 in an upright position when the portable armrest 500 is in use. In the first alternate embodiment, a lock 502 is formed using a safety tab mounted to a pivot fastener on a handle support 508. When the safety tab is pointed toward the base 102, the handle 600 can not be folded down and the handle 502 is secured in the upright position. When the safety tab, however, is moved to the side, the handle 502 can be folded down. Although in the first alternate embodiment a single lock 520 is used on one of the handle supports 508, in other alternate embodiments, each of the handle supports 508 may include a lock 520. As those with ordinary skill in the art will observe, adding a second lock 520 will provide additional support but will also inconvenience the user in that two safety tabs must be moved before the handle 502 can be folded down.

Figure 6:
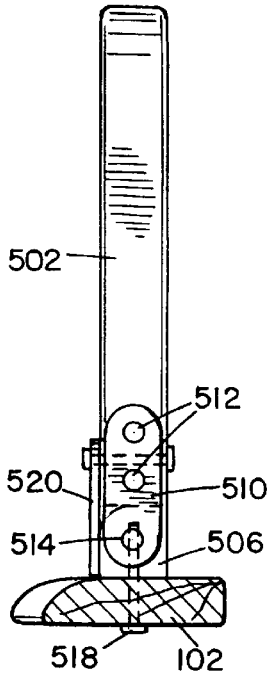
FIG. 6 is a drawing of a sectional view taken on line 6—6 of FIG. 5 of the portable armrest 500 in accordance with the first alternate embodiment of the invention.

FIG. 6 is a drawing of a sectional view taken on line 6—6 of FIG. 5 of the first handle 502 mounted on the base 102 in accordance with the first alternate embodiment of the invention. As is shown in FIG. 6., the hinge block 506 has a curved edge to allow the handle 502 to fold down. The dimensions of the curve are determined using well known techniques.

Figure 7:
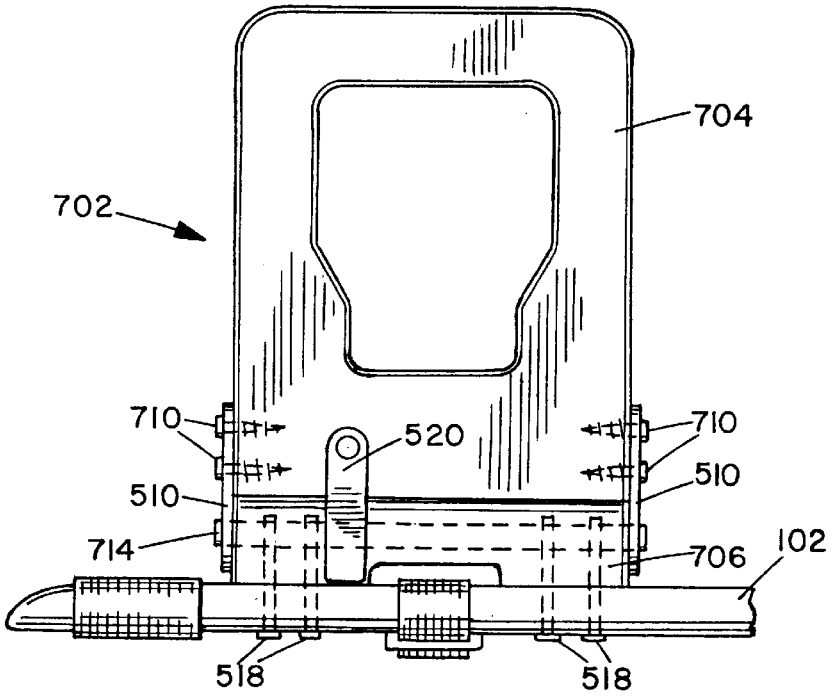
FIG. 7 is a drawing of a side view of a portable armrest 700 in accordance with a second alternate embodiment of the invention.

FIG. 7 is drawing of a side view of a portable armrest 700 in accordance with a second alternate embodiment of the invention. The second alternate embodiment of the invention is constructed as described above in regard to the first alternate embodiment except for modifications necessary for forming a hinge 702 from a single hinge and not from two hinge subassemblies. In the second alternate embodiment the first handle 704 is connected to a hinge block 706 using two metal plates 510. The metal plates 510 are secured to the handle using screws 710.

The hinge block 706 is attached to the base 102 with bolts 518 threaded through a cross dowel 714. The metal plates 510 have holes that are slightly larger than the cross dowel 714 allowing the metal plates 510 to move around the cross dowel 714.

Therefore, in the first and second embodiments, the portable armrest 500, 700 can be made into a compact and portable package when not use. The handles 506, 704 can be folded down when not in use and locked into an upright position when the user is using the portable armrest 506, 704.

Other embodiments of the invention may include molding the base 102 and handles 110, 112 from a single piece of material or constructing the base 102 from several individual pieces. Also, the handles may be attached to the base using various techniques including detachably connecting the handles 110, 112 to the base 102 using a dowel and socket joint so that they may be removed when not in use.

The portable armrest 100 may also be constructed to allow for adjustment to accommodate different users. For example, the base may be constructed from at least to separate pieces that can be moved in relation to each other to adjust the width of the opening. Further, the handles 110, 112 may be constructed to allow the distance form the base 102 to the top of the handle grip 402 to be changed.

Other embodiments and modifications of the present invention will occur readily to those of ordinary skill in the art in view of these teachings. Such persons will appreciate the symmetries among the various embodiments illustrated above and understand that their elements may be arranged in other ways to produce similar results.

Therefore, this invention is to be limited only by the following claims, which include all such other embodiments and modifications when viewed in conjunction with the above specification and accompanying drawings.

What is claimed is:

1. A portable armrest apparatus for assisting a user of an armless sitting device to change from a seated position on a seating surface of the sitting device to a standing position, the apparatus comprising:

a relatively flat, one-piece, U-shaped base having a curved rear portion and a pair of spaced, parallel, first and second side portions extending continuously from the curved rear portion, the base being adapted for placing flat on a seating surface with the rear portion adjacent a rear portion of the seating surface, the side portions being spaced apart by a predetermined distance sufficient to leave at least a major portion of the seating surface exposed between the side portions for allowing a user to sit on the seating surface without contacting the base, and the side portions having forward free ends which are spaced apart to provide a front opening to the base;

a first handle projecting upwardly from the first side portion of the base;

a second handle projecting upwardly from the second side portion of the base; and a flexible base strap of non-metallic material connected across the front opening between the opposite side portions of the base, the base strap comprising means for extending over the top of the seating surface and supporting the base above the seating surface when the base is placed onto the seating surface.

2. An apparatus in accordance with claim 1 further comprising:

a first hinge connecting the first handle to the base; and a second hinge connecting the second handle to the base, the first hinge and the second hinge allowing the handles to fold toward the base when the apparatus is not in use.

3. An apparatus in accordance with claims 2 further comprising:

a first lock adapted to secure the first handle in an upright position when the apparatus is in use; and a second lock adapted to secure the second handle in an upright position when the apparatus is in use.

4. portable armrest in accordance with claim 1 wherein the two handles and the base are molded from a single piece of plastic.

5. The apparatus as claimed in claim 1, wherein the base strap is of flexible fabric material.

6. The apparatus as claimed in claim 1, including a safety strap connected between the first and second side portions at a location spaced rearwardly from the base strap for extending beneath the seating surface to releasably secure the base to the seating surface.

7. The apparatus as claimed in claim 6, wherein the safety strap is releasably connected to the first and second side portions, whereby the strap may be removed when the apparatus is used in conjunction with a seating surface having a width greater than that of the base.

8. An apparatus in accordance with claim 6 wherein the safety strap has a buckle allowing a length of the safety strap to be adjusted.

9. An apparatus comprising:

a base adapted to interface to a seating surface, the base shaped to provide an opening exposing the seating surface and having a size allowing a user to sit on the seating surface within the opening when the base interfaces with the seating surface;

a first handle connected to a first portion of the base;

a second handle connected to a second portion of the base, wherein the first handle and the second handle are arranged to assist a user to change from a seated position on the seating surface to a standing position;

a base strap connected across the opening between the first portion of the base and the second portion of the base, the base strap adapted to support the base above the seating surface when the base interfaces with a seating surface having a width smaller than the opening;

a safety strap connected to the base across the opening between the first portion and the second portion of the base, the safety strap adapted to secure the base to the seating surface;

a first hinge connecting the first handle to the base; and a second hinge connecting the second handle to the base, the first hinge and the second hinge allowing the handles to fold toward the base when the apparatus is not in use.

10. An apparatus in accordance with claim 9 further comprising:

a first lock adapted to secure the first handle in an upright position when the apparatus is in use; and a second lock adapted to secure the second handle in an upright position when the apparatus is in use.

11. A portable armrest for assisting a user of an armless sitting device to change from a seated position on a seating surface of the sitting device to a standing position, the apparatus comprising:

a relatively flat curved base having a first portion and a second portion, wherein a first inner face of the first portion faces a second inner face of the second portion, the first portion of the base and the second portion of the base defining an opening between the first inner face and the second inner face, the opening exposing the seating surface to allow the user to sit on the seating surface when the apparatus is attached to the sitting device;

a first handle connected to the first portion of the base;

a second handle connected to the second portion of the base, the first handle and the second handle arranged to assist the user to change from a seated position on the seating surface to a standing position;

a base strap connected across the opening between the first portion of the base and the second portion of the base, the base strap adapted to support the base above the seating surface when the base interfaces with a seating surface having a width smaller than the opening;

a safety strap connected to the base between the first side of the opening and the second side of the opening, the safety strap adapted to secure the base to the seating surface;

a first hinge connecting the first handle to the base; and a second hinge connecting the second handle to the base, the first hinge and the second hinge allowing the handles to fold toward the base when the apparatus is not in use.

12. A portable armrest in accordance with claim 11 further comprising:

a first lock adapted to secure the first handle in an upright position when the apparatus is in use; and a second lock adapted to secure the second handle in an upright position when the apparatus is in use.

13. A portable armrest in accordance with claim 12 wherein each of the two hinges comprises two hinge subassemblies.

14. A combined seat device and portable armrest assembly for assisting a user of an armless sitting device to change from a seated position on a seating surface of the seat device to a standing position, the assembly comprising:

a seat device having a generally horizontal seating surface for supporting a user in a seated position, the seating surface having a forward edge and a rear end;

a relatively flat, one-piece, U-shaped base having a curved rear portion, a pair of spaced, parallel, first and second side portions, and a front opening, the base being placed flat on the seating surface with the rear portion adjacent the rear end of the seating surface and the front opening adjacent the front edge of the seating surface;

the side portions of the base being spaced apart by a predetermined distance sufficient to leave at least a major portion of the seating surface exposed between the side portions for allowing a user to sit on the seating surface without contacting the base, the side portions having forward free ends which are spaced apart to provide the front opening to the base;

a first handle projecting upwardly from the first side portion of the base;

a second handle projecting upwardly from the second side portion of the base; and a flexible base strap of non-metallic material connected across the front opening between the opposite side portions of the base and resting on top of the seating surface, the base strap comprising means for supporting the base above the seating surface when the base is placed onto the seating surface.

15. The assembly as claimed in claim 14, wherein the seat device has a lower surface and opposite side edges, and the base includes a safety strap connected between the first and second side portions at a location spaced rearwardly from the base strap, the safety strap extending from the first side portion around one side edge of the seat device, under the lower surface, and around the opposite side edge to the second side portion to releasably secure the base to the seating surface.

* * * * *